US009146541B2

(12) United States Patent
Billet et al.

(10) Patent No.: US 9,146,541 B2
(45) Date of Patent: Sep. 29, 2015

(54) DEVICE FOR RESETTING TO A PREDETERMINED POSITION AN INDICATOR MEMBER INDICATIVE OF A PARAMETER CONNECTED WITH TIME

(75) Inventors: Pascal Billet, Morbier (FR); Julien Cattaneo, Esery (FR); Marco La China, Geneva (CH); Denis Rudaz, Prévessin-Moens (FR); Fabiano Colpo, Lausanne (CH)

(73) Assignee: ROLEX S.A., Geneva (CH)

( * ) Notice: Subject to any disclaimer, the term of this patent is extended or adjusted under 35 U.S.C. 154(b) by 590 days.

(21) Appl. No.: 13/526,935

(22) Filed: Jun. 19, 2012

(65) Prior Publication Data

US 2013/0003507 A1 Jan. 3, 2013

(30) Foreign Application Priority Data

Jun. 29, 2011 (EP) ..... 11405275

(51) Int. Cl.
*G04F 7/08* (2006.01)

(52) U.S. Cl.
CPC ..... *G04F 7/0866* (2013.01)

(58) Field of Classification Search
CPC ..... G04F 7/08; G04F 7/0866; G04F 7/0871; G04F 7/0876
USPC ..... 368/106, 101
See application file for complete search history.

(56) References Cited

U.S. PATENT DOCUMENTS 4,389,122 A * 6/1983 Dubois et al. ..... 368/110
4,623,261 A * 11/1986 Muto ..... 368/110
7,422,364 B2 9/2008 Scheufele
2008/0043576 A1 2/2008 Scheufele
2008/0151698 A1 6/2008 Gil et al.

FOREIGN PATENT DOCUMENTS

CH 183 262 A 3/1936
CH 192 624 A 4/1937
CH 214664 A 5/1941
CH 253514 A 3/1948
CH 678 910 A3 11/1991
CH 698 827 B1 11/2009

(Continued)

OTHER PUBLICATIONS

Chinese Office Action dated Feb. 28, 2014, issued in counterpart Chinese Patent Application No. 2012102810216, w/English translation (20 pages).

(Continued)

*Primary Examiner* — Sean Kayes
(74) *Attorney, Agent, or Firm* — Westerman, Hattori, Daniels & Adrian, LLP

(57) ABSTRACT

A device (100; 200) for resetting to a predetermined position an indicator member (2, 13; 22) indicative of a parameter connected with time, notably a "flyback" device, the indicator member being kinematically linked to a drive mobile (15; 35), the device comprising an energy accumulator (9) and a return element (1; 21) for returning the indicator member indicative of the parameter connected with time to the predetermined position, the return element being powered by energy from the accumulator, the energy being supplied to the energy accumulator by a user via a control member (4) for resetting to the predetermined position, the control member being able to be manipulated by the user.

25 Claims, 19 Drawing Sheets

(56) References Cited

FOREIGN PATENT DOCUMENTS

| | | | |
|---|---|---|---|
| CH | 702 157 | A2 | 5/2011 |
| CN | 101126915 | A | 2/2008 |
| DE | 1312184 | U | 3/1934 |
| EP | 1 136 894 | A1 | 9/2001 |
| EP | 1 936 448 | A2 | 6/2008 |
| FR | 1 104 103 | A | 11/1955 |

OTHER PUBLICATIONS

European Search Report dated Dec. 14, 2012, issued in counterpart European Patent Application No. 12172936.2, w/English partial translation and machine translation (13 pages).
European Search Report (ESR) of EP11405275.6 and Written Opinion, mailing date of Nov. 25, 2011 with English translation of ESR and English machine translation of Written Opinion.

* cited by examiner

DEVICE FOR RESETTING TO A PREDETERMINED POSITION AN INDICATOR MEMBER INDICATIVE OF A PARAMETER CONNECTED WITH TIME

The invention relates to a device for resetting to a predetermined position an indicator member indicative of a parameter connected with time or time parameter, notably what is known as a "flyback" device. The invention also relates to a timepiece movement or to a timepiece equipped with such a device.

There is on the market some wrist watches, the sweep seconds hand of which can be reset to zero so that it can instantly restart. This function is commonly known as "flyback" and needs to be differentiated from split-time counter mechanisms which are sometimes also designated by the name "flyback".

Such a function is commonly performed by a synchronous zero-reset device controlled by a control member the actuation of which causes the seconds hand to be reset to zero, and release of which causes this hand to restart. Such a device needs to be differentiated from an asynchronous zero-reset device in which the action of a control member firstly resets the seconds hand to zero and then secondly restarts it. As depicted in FIG. 1, the operation of the synchronous mechanism is thus synchronized with the actions of the wearer of the wrist watch, the pressing of a push button leading to the zero reset and release leading to the restarting of the seconds hand. As a result, the rapidity with which the timing is performed is dependent on the dexterity of the user. The functionality of such a device is therefore limited by comparison with that of an asynchronous zero-reset device. Further, this synchronous device is generally attached to chronograph mechanisms. In this case, the "flyback" mechanism is dependent on the clutch system of the chronograph and on the high number of components necessary to operate it. Another solution is to mount the sweep seconds hand using friction within the basic movement. Such a construction has the advantage of employing a small number of component parts and of not requiring a clutch. However, the friction is subject to wear and prolonged actuation of the control member carries the risk of disrupting the chronometry of the movement or even of causing the watch to stop. This is because the friction consumes energy which is tapped from the energy needed for correct chronometric operation of the movement.

Document CH183262 describes a modification to a chronograph mechanism with horizontal clutch. Hammers are fitted in such a way as to allow the counting chain to be disengaged upon inadvertent zero reset without having stopped the chronograph beforehand. Release of a push button disconnects the panes of a hammer from zero-reset heart-pieces and causes the counting chain to reengage again. This mechanism is dependent on the full chronograph mechanism. What is more, correct operation of such a system entails a considerable number of adjustments and does not allow the use of an asynchronous zero-reset device.

Document CH 214664 relates to a horizontal clutch device with no release system (various types of release levers and column wheel). A control member is in direct engagement with a "flyback" mechanism. Pressing a push button causes the movement of a hammer which, in one operation, acts on a zero-reset heart-piece and disengages the counting chain which is positioned on a rocking lever of the kinematic chain of the movement. Releasing the push button allows the sweep seconds hand to restart. Despite having a lower number of components by comparison with the conventional chronograph mechanism, the mechanism for synchronizing the zero reset and controlling the disengagement is particularly tricky to develop. Moreover, such a system does not allow the use of an asynchronous zero-reset device.

Document EP1136894A1 describes a chronograph mechanism with vertical clutch which comprises a hammer designed to actuate additional disengagement means for flyback zero reset. The mechanism is disengaged and the seconds hand is reset to zero while the user is pressing a push button. Correct operation of this mechanism is dependent on development of the vertical clutch and what is more requires an additional control to actuate it. Furthermore, such a system does not allow the use of an asynchronous zero-reset device.

Document FR1104103 describes a device that has no clutch. A sweep seconds hand is friction mounted on a seconds hand pinion. Pressing a push button causes action of a hammer which acts on a sweep seconds hand zero-reset heart-piece. The friction generated between the seconds hand pinion and the seconds hand remains for as long as the user has not released the push button. This synchronous device therefore carries the risk of disrupting the chronometry of the movement or even of causing the watch to stop. The hammer is returned to position by a wire spring when the push button is released. The seconds hand is then once again driven in rotation. In fact, this system does not allow the use of an asynchronous zero-reset device.

Document CH698827 describes a synchronous zero-reset device. This uses a control member which is designed to collaborate with a return spring so as to allow the hammers to return to the position of rest once the control member is no longer being actuated. Such a system therefore does not allow the use of an asynchronous zero-reset device.

Document CH702157 describes a simplified chronograph device actuation of the single control member of which resets the seconds and minute hands to zero, and release of which causes them to restart. The system is reduced to the horizontal clutch mechanism of the chronograph and to the zero-reset device, which are designed to allow the counting chain to be disengaged during actuation of the hammers on the heart-pieces. Such a system allows the use of a synchronous zero-reset device through a suitable zero-reset device, but does not allow the control member, the horizontal clutch and the hammers to be adapted in such a way as to define an asynchronous zero-reset device.

Document CH678910 describes an adaptation of at least two hammers so as to allow their positioning with respect to their respective heart-piece to be adjusted. That document does not divulge any elements that allow these hammers to be shaped in such a way that they could potentially be incorporated in a system designed to equip an asynchronous zero-reset device.

Document EP1936448 describes a device for displaying on demand a time indication and controlled by a pusher. The system comprises a cam, a cam follower secured to a rack, and a pinion in mesh with the rack. The latter is returned by a return spring as soon as the push button is no longer actuated. This then is a device in which the control member is perfectly synchronized with the display device.

In the light of these documents, these solutions make it possible to arrive at the use of synchronous zero-reset devices in which the return elements, namely the hammers or the racks, are actuated directly by a control member, possibly by a control member combined with a return spring, independently of any third-party device. In fact, these solutions do not allow the use of an asynchronous zero-reset device in which the action of a control member firstly causes an indicator member indicative of a parameter connected with time to be reset to a predetermined position and secondly causes it to be restarted.

Document CH192624 describes one embodiment of a flyback device which has the specific feature of being asynchronous: it is the action of depressing a push button which allows the seconds hand to be reset to zero and then restarted. The action of the push button is transmitted to a zero-reset hammer via a cam and a control lever. The cam has rotational mobility and collaborates with a return spring. This cam has an inclined surface designed to collaborate with the control lever during zero resetting. The action of the hammer on the heart-piece is interrupted once the control lever has reached the end of the inclined plane. The spring which collaborates with the cam allows it to retract so as to interrupt the action of the control lever on the hammer which reverts to its initial position under the action of a second return spring, irrespective as to whether or not the push button is still depressed. This mechanism does not, however, remove the risk of the seconds hand lingering at zero nor does it remove the risk of stopping the seconds hand for a prolonged period and therefore disrupting the working of the movement. Furthermore, there is no device provided for generating a clear sensation that the user can feel as soon as he begins to activate the push button. Finally, depressing the push button partially may cause the seconds hand to return partially to its zero position, through the incomplete action of the hammer on the heart-piece. Such a possibility is undesirable.

In the light of these documents, and more particularly in the light of the last aforementioned document, none of the solutions makes it possible to arrive at the use of an asynchronous zero-reset device that is reliable and makes it possible, in one and the same single operation, to reset to zero instantly and then instantly restart an indication connected with time, for example seconds, and do so independently of the operations performed by the user.

It is an object of the invention to provide a device for resetting an indicator member to a predetermined position, preferably of the asynchronous type, that overcomes the abovementioned disadvantages and improves the devices known from the prior art for resetting to a predetermined position. In particular, the invention proposes a device for resetting to a predetermined position that is reliable and allows an indicator member indicative of a parameter connected with time, for example a seconds hand, to be reset to a predetermined position in one single same operation on the part of the user, for example by pressing a push button.

According to a first aspect of the invention, the device for resetting to a predetermined position is defined by claim 1.

Various embodiments of the device are defined by claims 2 to 15.

According to a second aspect of the invention, the device for resetting to a predetermined position is defined by claim 16.

One embodiment of the device is defined by claim 17.

A timepiece movement according to the invention is defined by claim 18.

One embodiment of the timepiece movement is defined by claim 19. A timepiece according to the invention is defined by claim 20.

The appended drawings depict, by way of examples, two embodiments of a device for resetting to a predetermined position an indication connected with time.

Figure 1:
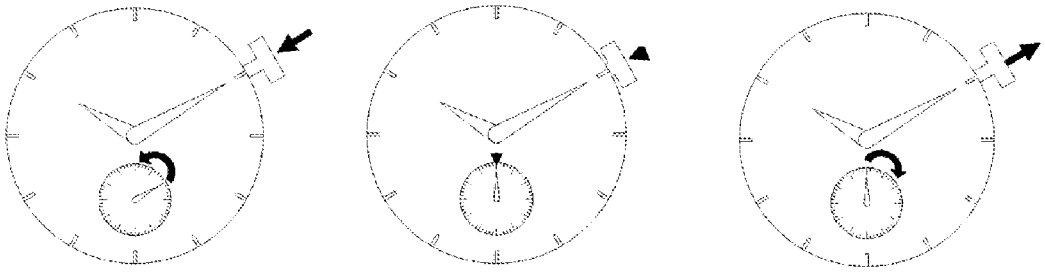
FIG. 1 is a diagram of a timepiece comprising a synchronous device for resetting to a predetermined position.
Figure 2:
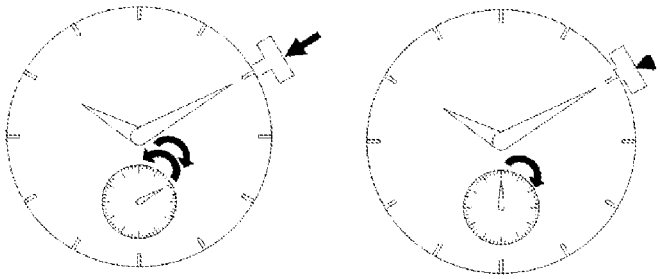
FIG. 2 is a diagram of a timepiece comprising an asynchronous device for resetting to a predetermined position.

A first embodiment of a device 100 for resetting to a predetermined position an indicator member 13 indicative of a parameter connected with time is described hereinafter with reference to FIGS. 2 to 9. This device is intended to equip a timepiece movement, notably a movement of a wrist watch. For example, this device is a "flyback" device allowing a hand that indicates the seconds or any other time parameter to be reset to a predetermined position. In particular, the predetermined position may be an initial position or a position indicating zero or any other origin. For preference, the action of the device is controlled by a single action on the part of a user, particularly an action of the user pressing a push button. This action of the user pressing the push button makes it possible, as depicted in FIG. 2, to cause the indicator member to return to the predetermined position and then the drive of this indicator member to be resumed in a space of time lasting of the order of one tenth of a second. This resumption of drive is therefore considered to be instantaneous and is not dependent on the user releasing the push button but merely dependent on the time taken for the device to complete the function initiated by the action from the user. Keeping the push button depressed thereafter has no effect on the operation of the indicator member. Likewise, release of the push button has no effect on the operation of the indicator member. The resumption of drive is therefore independent of the position of the control member.

The indicator member 13 is kinematically linked by friction to a drive mobile 15. This drive mobile is itself driven by a movement transmission chain comprising a wheel 19, in the known way, from a driving member such as a barrel. Thus, if the device for resetting to a predetermined position is not powered, the indicator member indicative of a parameter connected with time is permanently driven in motion because it is kinematically linked by friction to the driving member.

The device for resetting to a predetermined position chiefly comprises an energy accumulator 9 and a return element 1 for returning the indicator member indicative of the parameter connected with time to the predetermined position. The return element is powered by energy from the accumulator or the return element is operated using energy from the accumulator. The repositioning device further comprises a movement transmission element transmitting movement from the energy accumulator to the return spring and an energy transmission element transmitting energy to the energy accumulator and for triggering operation of the return element. The transmission of energy to the accumulator can be done from a pusher 4. Operation of the return element can be deliberately triggered by action on the pusher. This pusher can be operated by a user and is able to act on the transmission element that transmits energy to the energy accumulator and that triggers action or operation of the return element.

The return element comprises a hammer 92 able to act on a cam 2, notably a heart cam or a heart-piece, kinematically connected in terms of rotation to the indicator member 13 and mounted to rotate about an axis 1'. The heart-piece 2 is preferably fixed to the indicator member 13. When the return element is powered, the hammer, as described later on, performs a rotational movement about the axis 1', notably a rotation movement of one revolution or a rotational movement of half a revolution. The hammer comprises a pane 92*a* intended to collaborate with the heart-piece and to act on a portion of the profile thereof in order to cause it to rotate until the indicator member has reached the predetermined position. Moreover, the hammer comprises a securing element 92*b* intended to collaborate with a portion of the profile of the heart-piece in order to stop or to immobilize it and therefore stop or immobilize the indicator member in the predetermined position. Overall, the hammer is in the form of a disk having a notch forming the pane 92*a* and a cutout 92*c* allowing the heart-piece to rotate freely about the axis 2' when the hammer is in a rest position. Unlike the hammers that are pivot-mounted about axes known from the prior art, the hammer moves in just one direction of rotation. For example, it performs one revolution on itself or one fraction of a revolution. It does not return to its initial position by reversing the direction in which it travels or rotates. The hammer moves in one direction when powered, which means to say from its rest position to its rest position via a position of contact with the heart-piece with which it collaborates.

The transmission element that transmits movement from the energy accumulator 9 to the return element 1 comprises a first cam 7 kinematically linked to the return element, notably kinematically linked to the hammer. In particular, the first cam 7 may be fixed to the hammer. The first cam 7 is therefore able to rotate about the axis 1'. The movement transmission element also comprises a runner or roller 8*a* kept in contact with the first cam 7 by the energy accumulator, notably by an elastic element, such as a leaf spring 91 of the energy accumulator. This runner is mounted to rotate freely and is intended to run along the profile of the first cam 7. For example, the runner 8*a* is mounted with the freedom to rotate on a lever 8 mounted to pivot about an axis 8'. In this case, the spring 91 acts on the lever to return the runner 8*a* against the first cam 7. Alternatively, the lever 8 and the spring 91 may be combined into one single component and the end of the lever 8 may collaborate with the profile of the cam 7, independently of the runner 8*a*.

The transmission element that transmits energy and triggers activation or operation of the return element comprises a rocking lever 3 and a second cam 6. The second cam 6 is kinematically linked in terms of rotation to the return element 1. For example, the second cam 6 is fixed to the first cam 7. This fixing may, as depicted, be achieved by a notch on the second cam collaborating with a pin on the first cam 7. The rocking lever 3 is able to act on the second cam 6 to cause it to turn. To do this, the second cam 6 comprises a notch 6*a* intended to collaborate with the rocking lever 3 and, more precisely, with a finger 5 pivot-mounted about an axis 5' and returned to a rest position against a stop 12 by an elastic element 11. The finger 5 is therefore retractable. Thus, the rocking lever 3 acts on the second cam 6 via the finger 5. The rocking lever is mounted to pivot about an axis 3'. The pivoting movement of the rocking lever is brought about by the translational movement of the pusher 4 when the latter is actuated by the user. This actuation of the rocking lever is performed against the action of a return spring 10. This spring allows the rocking lever to be returned to a position of rest when there is no longer any action on the pusher. Thus, its functionality is the equivalent of that of the springs designed to collaborate with the return elements and/or the control members of the zero-reset devices known from the prior art.

The pusher may of course be replaced by any type of control member.

Figure 9:
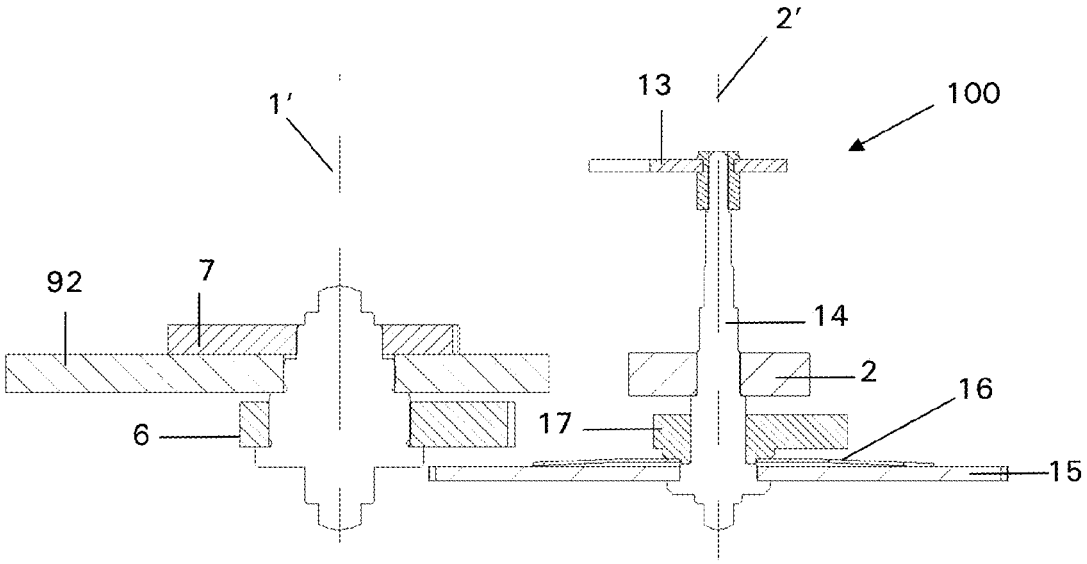
FIG. 9 is a view in cross section of the first embodiment of the device for resetting to a predetermined position, the plane of section IX-IX of which is indicated in FIG. 3.
Figure 10:
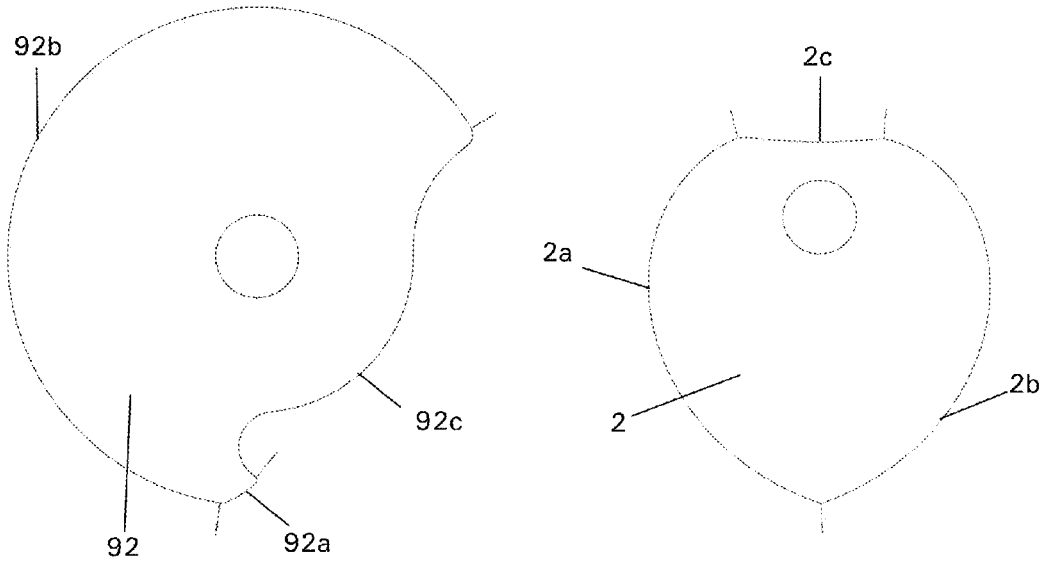
FIG. 10 is a detailed view of one example of a hammer/heart-piece assembly for performing the action of resetting to a predetermined position.

The indicator member 13 and the heart-piece 2 may be driven onto a spindle 14 as depicted in FIG. 9. The wheel 15 of the indicator member 13 is friction mounted on this assembly via a spring 16 to allow the indicator member to be disengaged from the transmission chain when the indicator member is being reset to the predetermined position. The friction spring 16 is sized to keep the indicator member 13 and the wheel of this indicator member 15 together in the event of an accidental knock but is also designed to allow, in all scenarios, the indicator member to be reset to the predetermined position using the energy accumulated by the spring 91. As an option, a bob weight 17, secured to the spindle 14, may advantageously counterbalance the imbalance caused by the indicator member and thus minimize its sensitivity to knocks.

As depicted in FIG. 2, a device for resetting an indicator member to a predetermined position as described hereinabove may be fitted to a timepiece movement or to a timepiece.

Operation of the device for resetting to a predetermined position is described hereinafter with reference to FIGS. 4A to 8 (which detail the operation of the transmission element that transmits energy to the energy accumulator and triggers the operation of the return element) and to FIGS. 11 to 18 (which detail the operation of the return element and how it interacts with the indicator member).

Figure 4A:
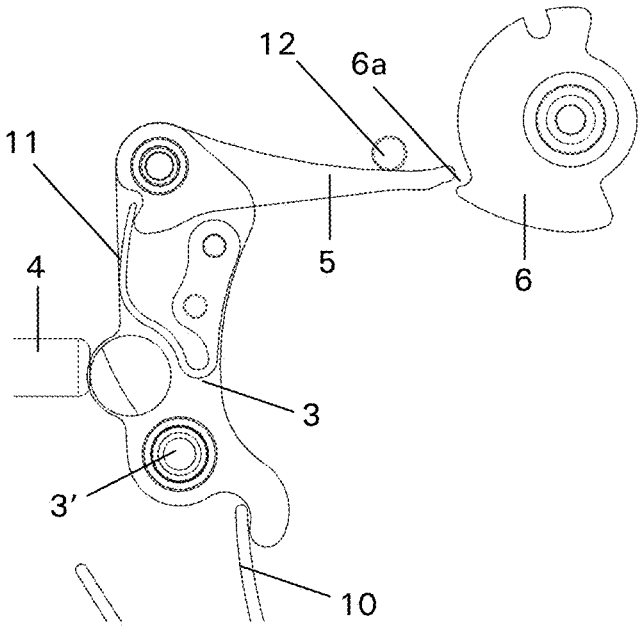
Figure 4B:
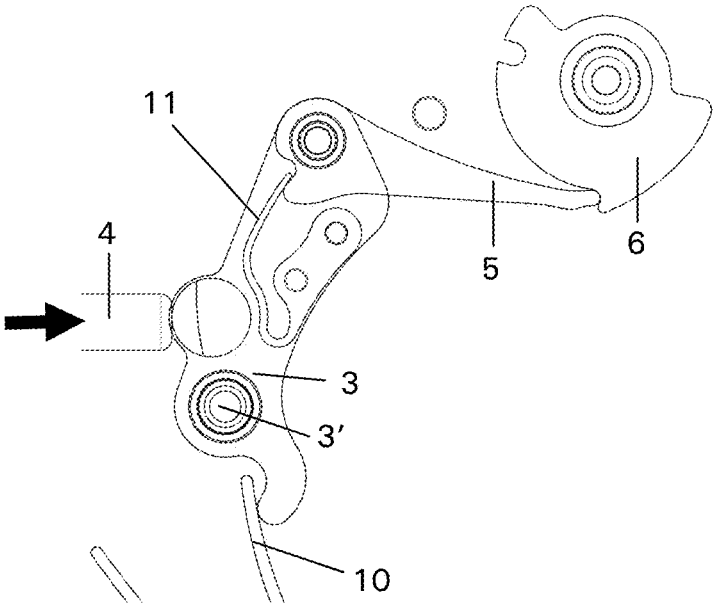
Figure 5:
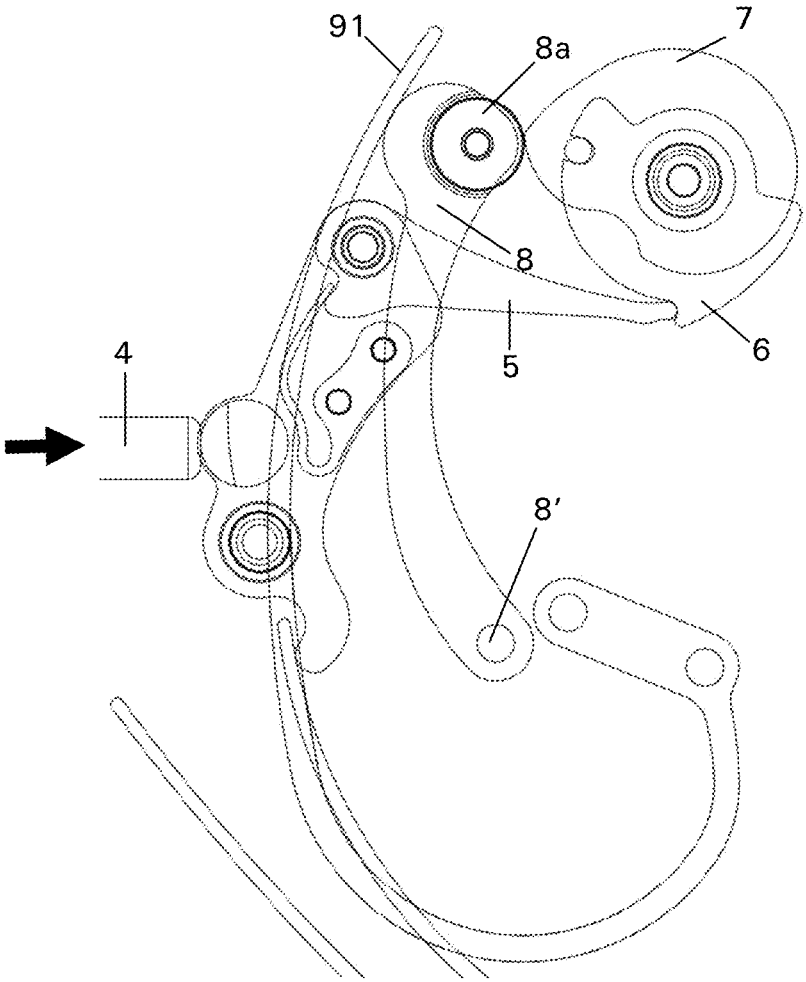
Figure 6:
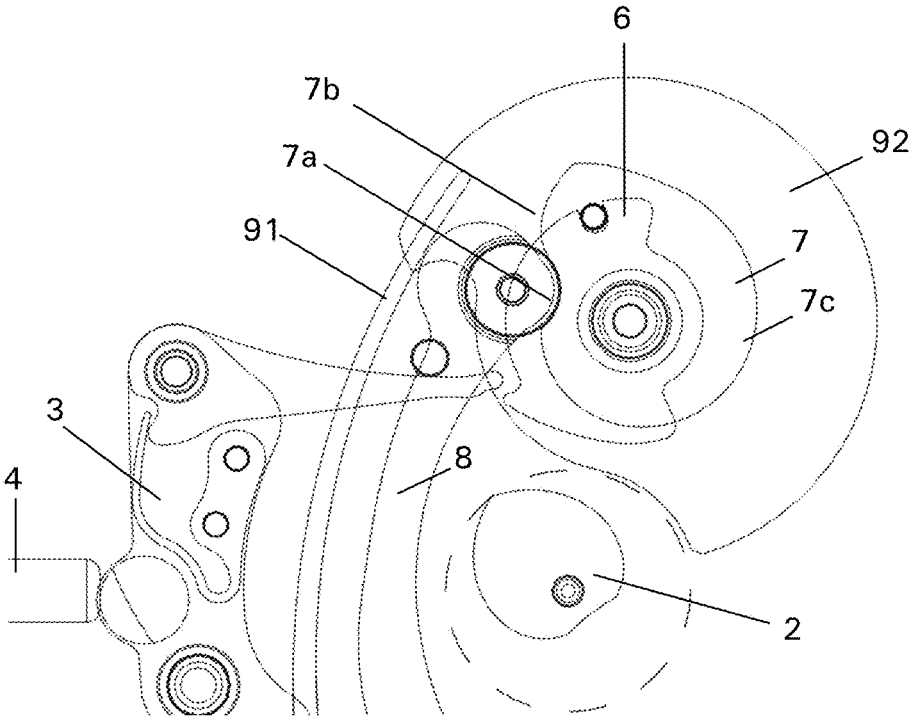
Figure 7A:
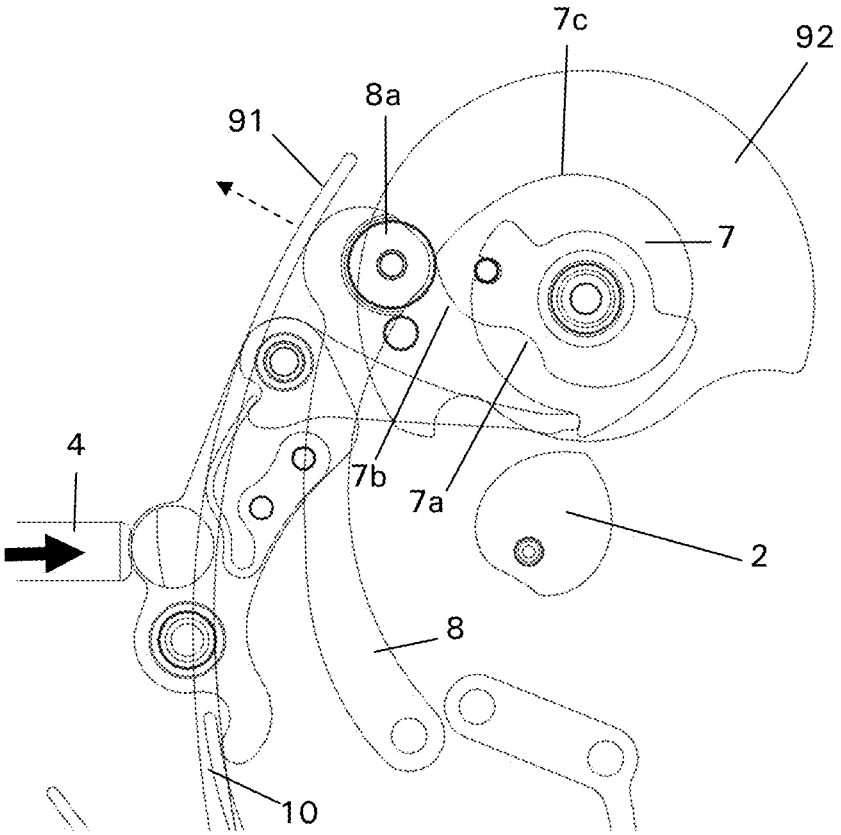
Figure 7B:
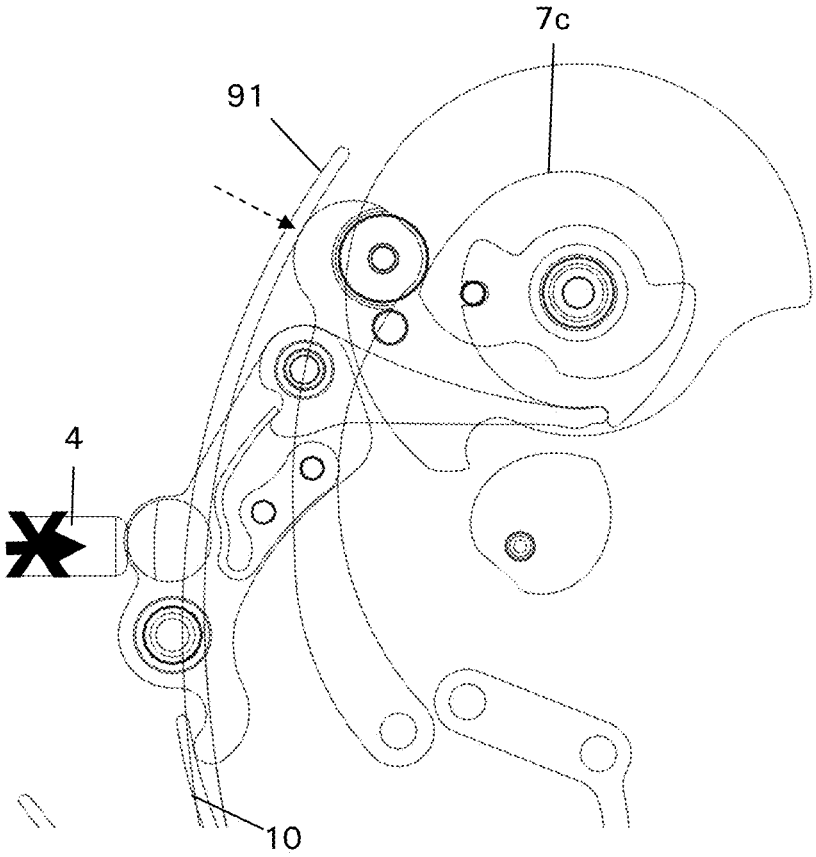
Figure 8:
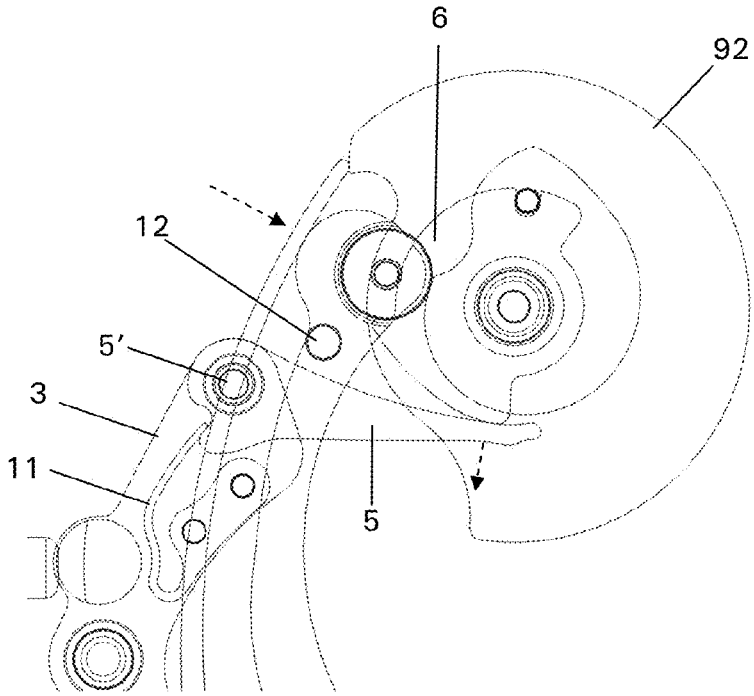

FIG. 4A illustrates the energy transmission element at rest, when the user is not acting on the pusher 4. Actuation of this pusher, as depicted in FIGS. 4B, 5 and 7A, causes the rocking lever 3 to pivot about the axis 3' against the action of the spring 10. This pivoting leads to an action of the finger 5 on the second cam 6 at the notch 6*a*. This action leads to the rotation of the second cam 6 about the axis 1'. The rotation of the second cam 6 about the axis 1' causes that of the first cam 7 about the same axis. It then follows, as depicted in FIGS. 5 and 7A, that the runner 8*a* leaves its rest position defined by a first portion 7*a* of the first cam and arrives on a second portion 7*b* of the second cam. The rest position defined by the first portion 7*a* makes it possible, through action of the spring 91, to immobilize the first cam 7 in terms of rotation and therefore immobilize the hammer in terms of rotation when the control member 4 is not being actuated. By running along the second portion 7*b*, the runner 8*a* moves away from the axis 1' of rotation of the first cam. This results in a pivoting of the lever 8 and therefore in a deformation of the spring 91 which stores up energy supplied by the user in operating the control member 4. This energy is accumulated by means of the second profile 7*b* of the first cam 7 which rotates through an angular range Φ from the rest position illustrated in FIG. 11 as far as a position depicted in FIG. 12 in which the runner 8*a* reaches a junction 7*d* between the second profile 7*b* and a third profile 7*c*. Up to this position, the second cam 6 is always driven in rotation by the action of the rocking lever 3 via the finger 5. This third profile 7*c* is of the spiral or scroll type. Thus, as soon as the runner 8*a* arrives on this profile, as depicted in FIGS. 7B, 13, 14, 15, 16, 17 and 18, the return action returning it against the first cam 7 leads to a mechanical action of the runner 8*a* on the first cam 7, thereby creating a mechanical torque about the axis 1' of rotation of the first cam 7. It then follows that the first cam 7 is rotationally driven using the energy of the spring 91. No further action on the control member 4 or on the rocking lever 3 is required. In particular, the control member 4 can be released. The hammer 92 rotates in a space of time lasting of the order of one tenth of a second when the spring 91 releases the accumulated energy, thereby imparting a rotational movement to the first cam 7 via the lever 8 and its runner 8*a* collaborating with the third profile 7*c*. In the circumstance where the control member has not been released, rotation of the hammer 92 does not interfere with the rocking lever because, as depicted in FIG. 8, the rotation of the second cam 6 is designed to release the finger 5. To do this, the finger 5, pivoted to 5' on the rocking lever 3, collaborates with the spring 11 and a stop 12, mounted on the supporting structure, which hold it in position when the control member is not being actuated.

Figure 3:
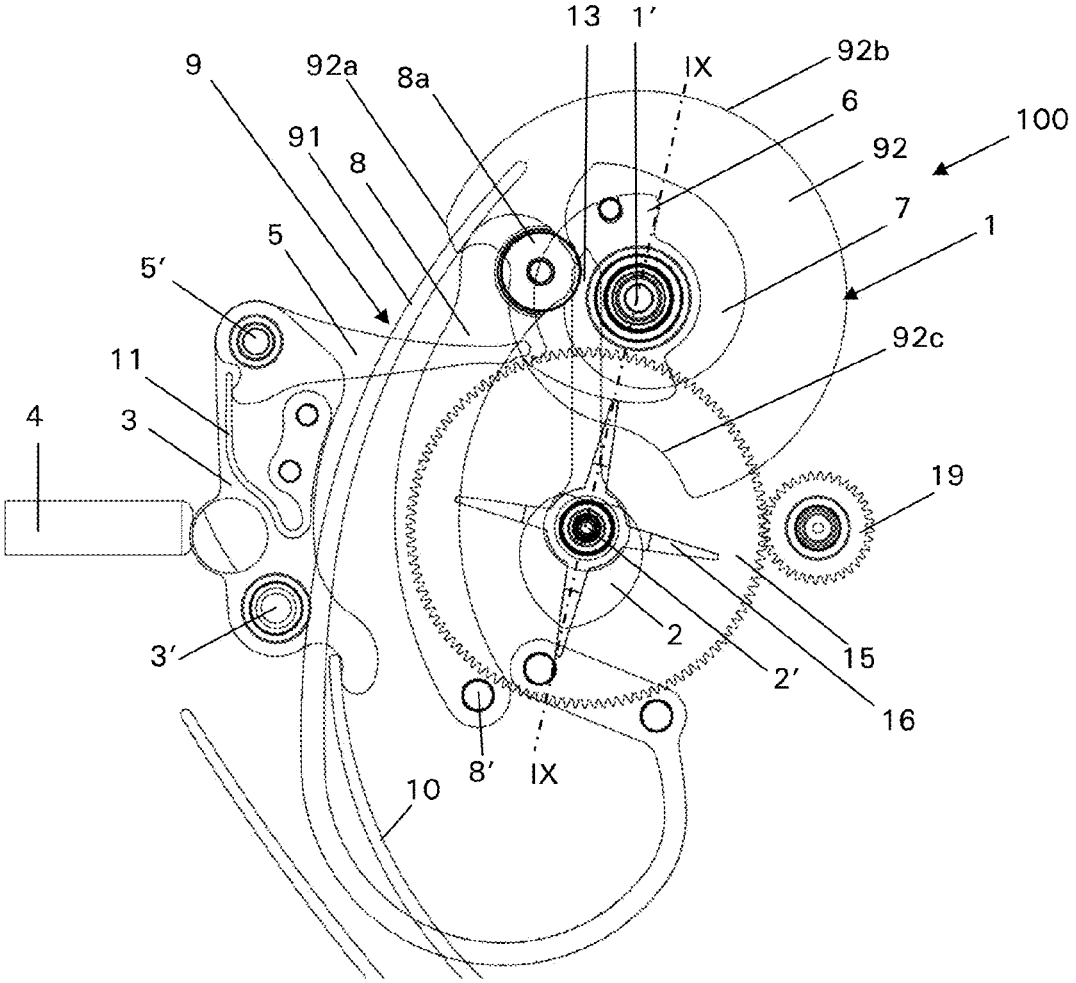
FIGS. 3 to 8 are views of a first embodiment of a device for resetting to a predetermined position according to the invention, depicted in various configurations.
Figure 11:
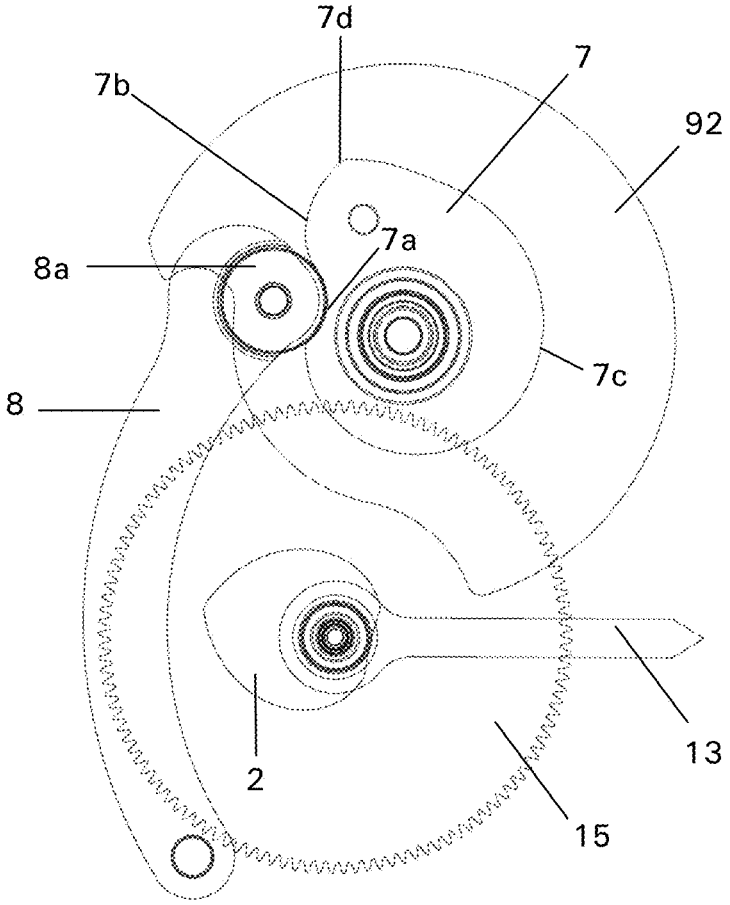
FIGS. 11 to 19 are views of the hammer/heart-piece assembly in successive configurations during a phase of resetting to a determined position.
Figure 12:
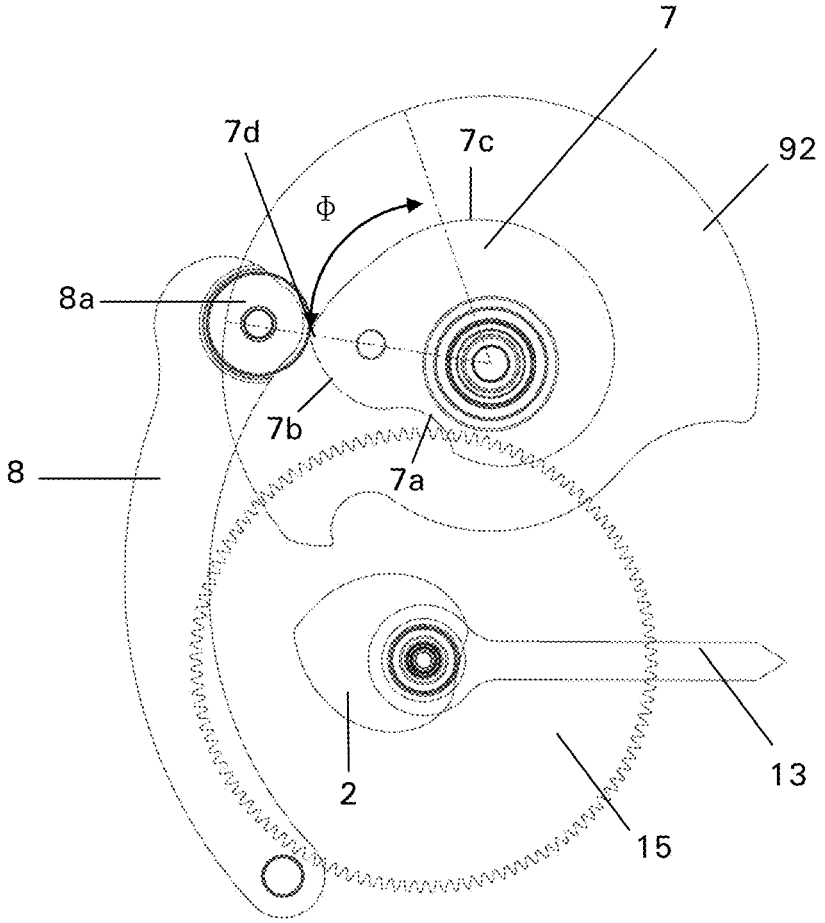
Figure 13:
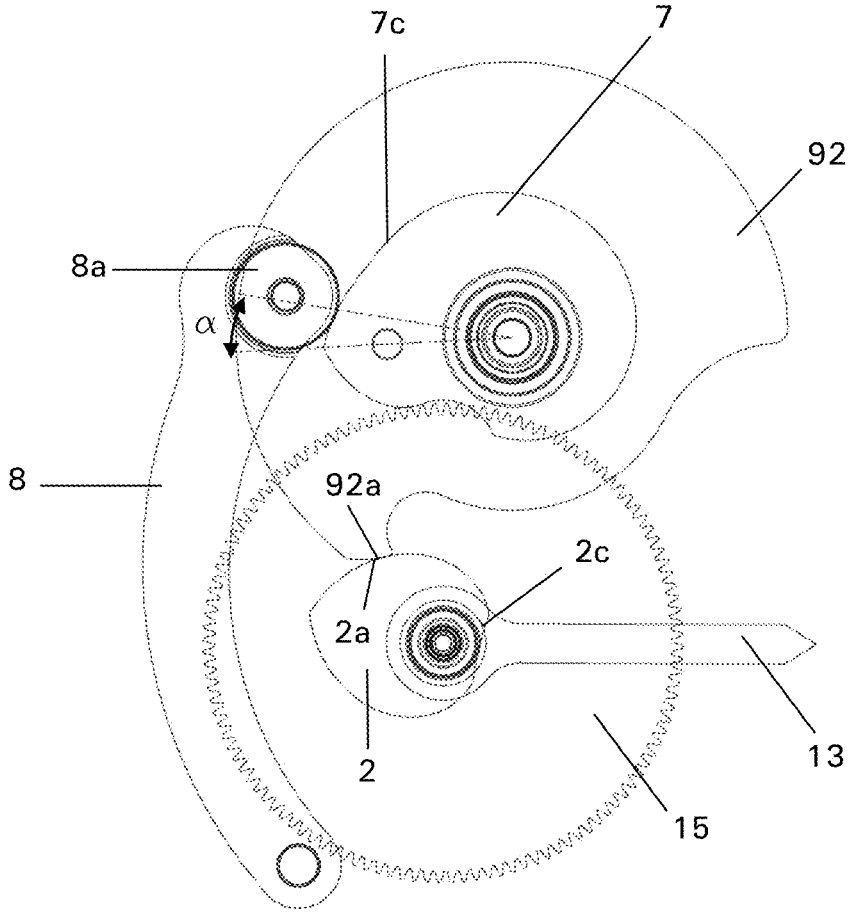
Figure 14:
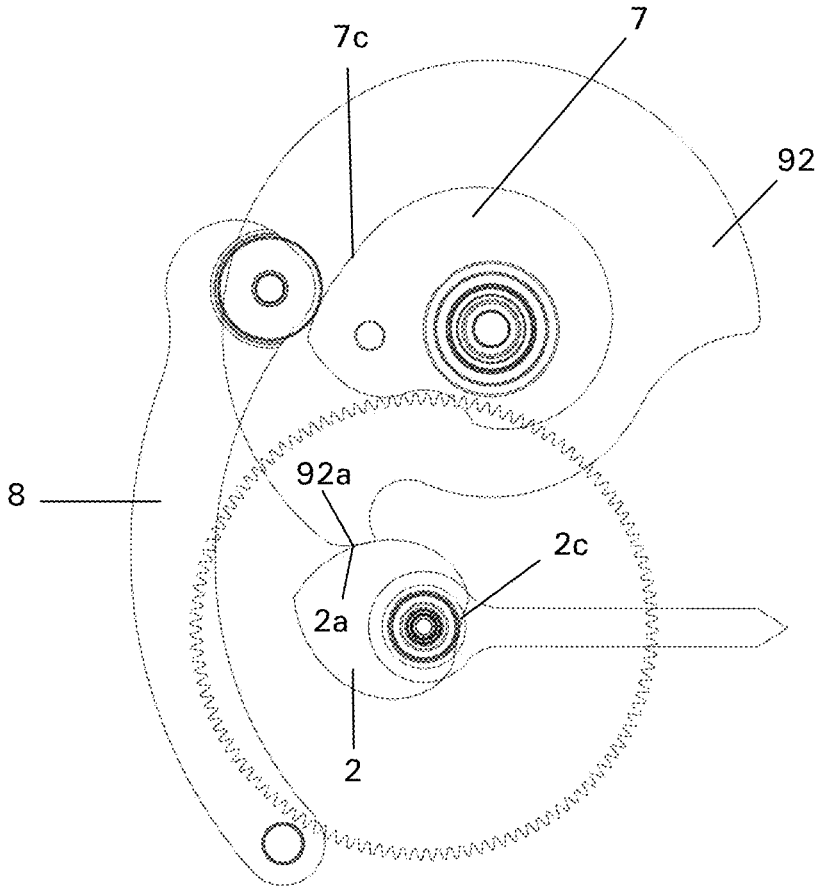
Figure 15:
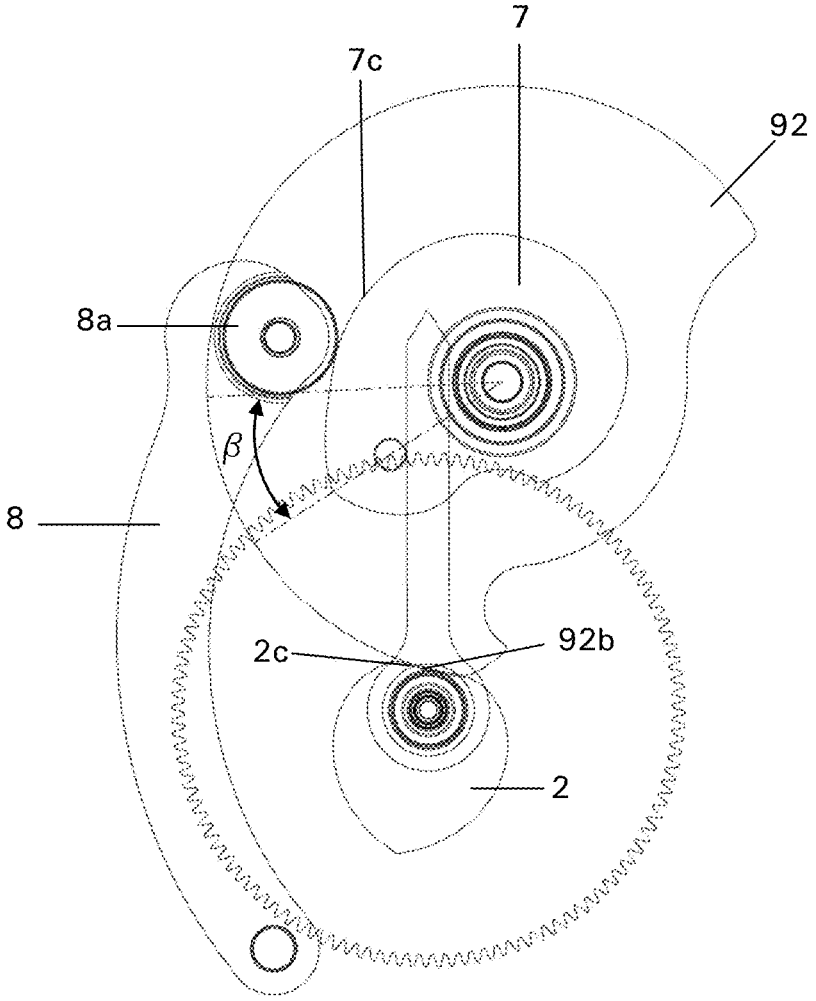
Figure 16:
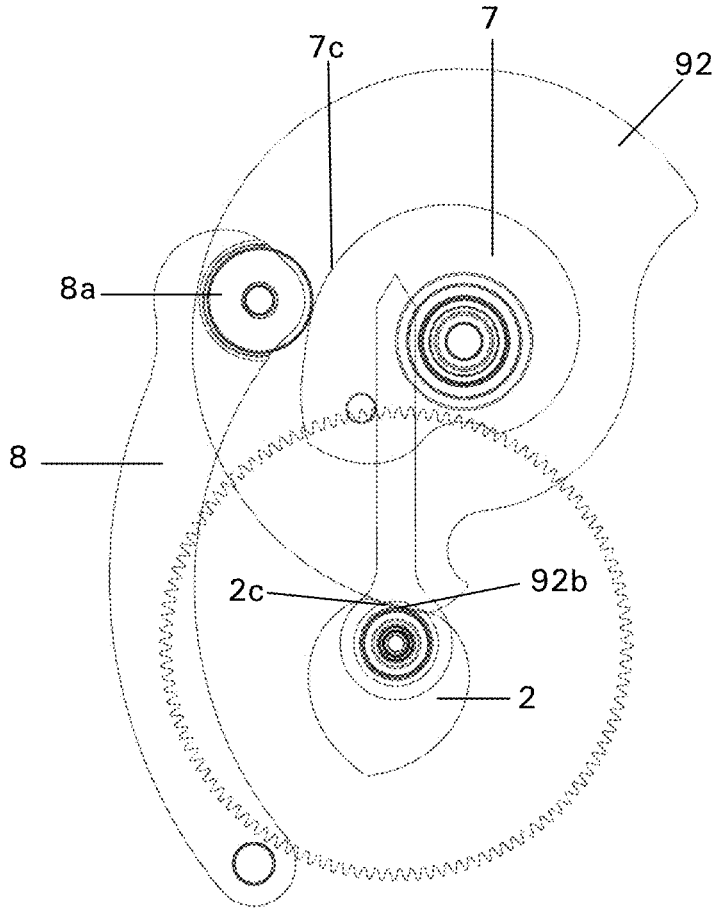
Figure 17:
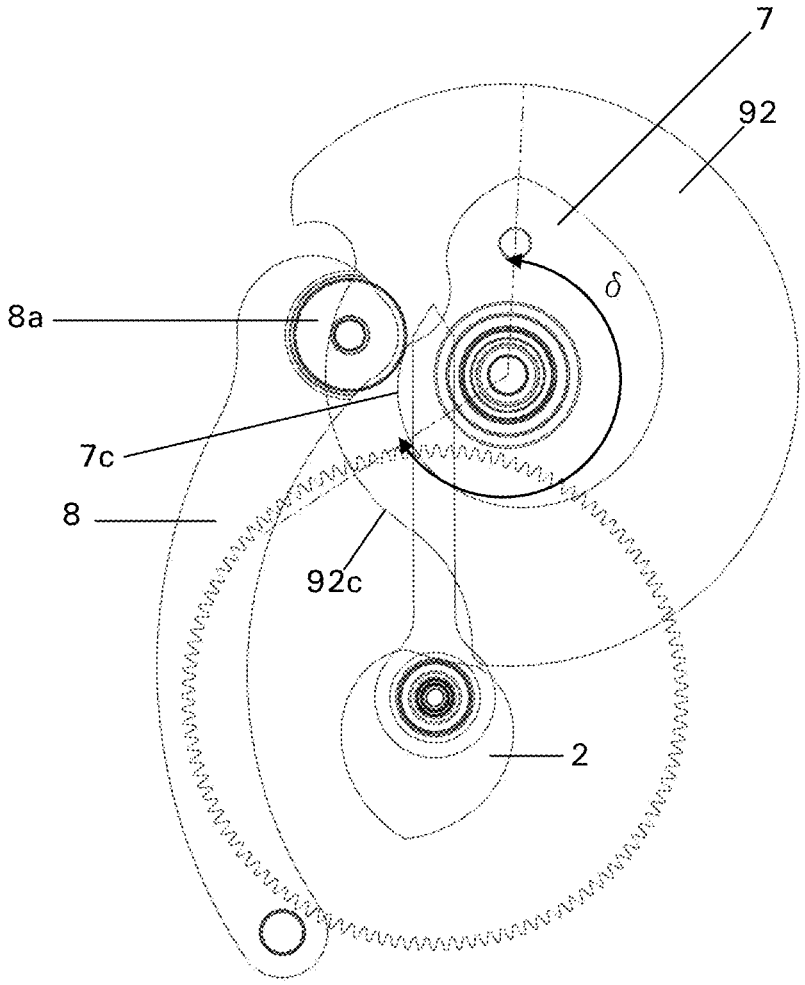
Figure 18:
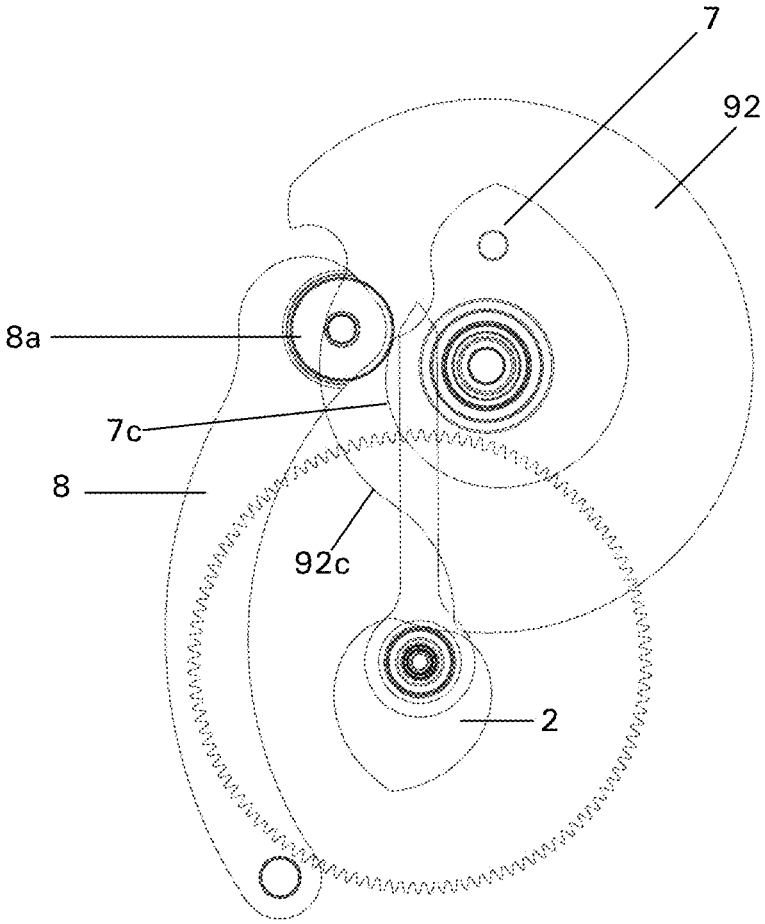
Figure 19:
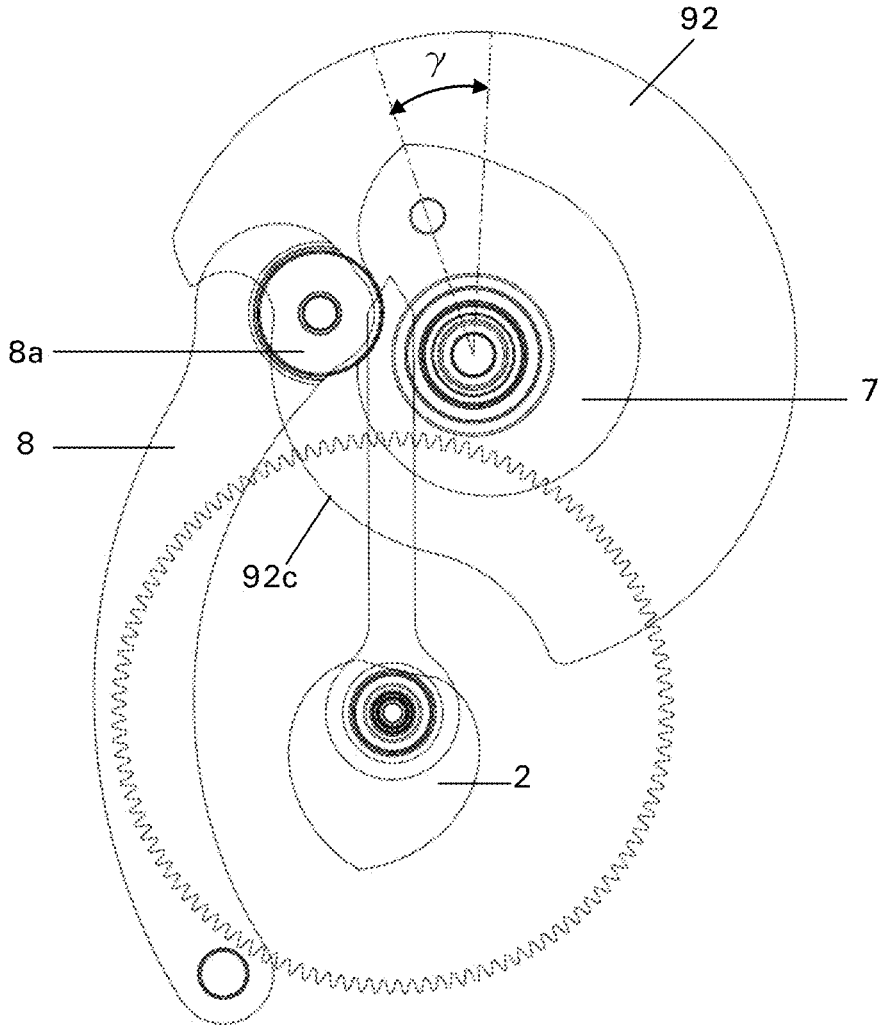

In other words, as long as the hammer 92 is not interfering with the heart-piece 2, the indicator member 13 is driven in rotation by the transmission chain via the friction connection, as shown in FIGS. 3, 4A and 11 for example. When the user actuates the control member 4 and triggers the energy-transmission element formed of the rocking lever 3 and the finger 5 (FIG. 4B), a rotation of the cam 6, and therefore of the hammer 92, is initiated. The runner 8*a* travels along the second profile 7*b* of the cam 7 and arrives at the junction 7*d* between the second and third profiles of the cam 7, as illustrated in FIGS. 5 and 12. This cam has then moved through an angle $\phi$ from its initial position depicted in FIG. 11. Once this energy-accumulation phase is over, the runner travels along the third profile 7*c* of the cam 7 until the surfaces 92*a* of the hammer 92 and 2*a* of the heart-piece 2 first make contact. This movement corresponds to a rotation of the first cam 7 through an angle $\alpha$ as depicted in FIG. 13. The pane 92*a* of the hammer 92 then acts on a surface 2*a* of the heart-piece 2 to return the indicator member 13 to a predetermined position as depicted in FIG. 14. There is therefore slippage at the friction connection, the drive mobile 15 still being driven. After a rotation through an angle $\beta$, a securing profile 92*b* of the hammer comes into contact with a profile 2*c* of the heart-piece, as depicted in FIGS. 15 and 16. The indicator member has been returned to a predetermined position and is immobilized in this position while the hammer moves through an angular arc $\delta$ as depicted in FIG. 17. Once this angular travel has been completed, the hammer no longer interferes with the heart-piece and the indicator member is once again driven in rotation via the friction connection from the predetermined position as depicted in FIG. 18. The hammer and the first and second cams then continue their rotation through an angular arc $\gamma$ until the runner 8*a* comes to the first profile 7*a* of the first cam, as depicted in FIG. 19.

The amplitudes of the angular ranges are of course dependent on the relative position of the heart-piece 2 with respect to the hammer 92.

The device for resetting the indicator member to a predetermined position is designed to alleviate the dynamic effects generated by the restitution of energy of the spring 91. To achieve this, the kinematics and the geometry of the hammer 92 have been developed firstly to perform the setting in position, and secondly to lock the angular position of the heart-piece 2 after the setting in position.

The collaboration between the hammer 92 and the heart-piece 2 can be likened to a Maltese cross system during the securing phase. In particular, the profiles 92*b* and 2*c* may complement one another and be formed at least partially of the arc of a circle of comparable, or even identical, radius of curvature.

Thanks to the device according to the invention, an energy accumulator forms the interface between the control member and the element for returning to the predetermined position. Energy produced by actuating the control member is transmitted to the energy accumulator whence it is later restituted, notably in a fraction of a second, to the element providing return to a predetermined position. In other words, the return element is powered by energy from an accumulator, the energy being supplied to the energy accumulator beforehand by the control member. In this way, the user can never act directly on the element providing return to the predetermined position. Such a design therefore makes it possible for the flyback function to become more reliable and makes it possible to avoid any chronometric degradation due to the friction clutch mechanism.

When the return element acts on the indicator member indicative of the parameter connected with time, the energy of this action is integrally supplied or provided by the energy accumulator. This energy has been stored in the accumulator before. This energy is stored by an action of a user on the accumulator, in particular an action of a user on the accumulator via the control member.

The energy accumulator is a system which has been completely mastered. It is therefore easy to design and to implement.

The energy accumulated by the device is the energy supplied by the user. The feel on the pusher is therefore well defined, and is dependent on the energy accumulator. A timepiece equipped with such a device for resetting to a predetermined position therefore does not require any additional mechanism designed to create an opposing force on the pusher, as is required on known chronographs of the prior art.

The energy transmitted to the hammer allows it, over all tolerance ranges, to overcome the friction torque generated by the friction connection which needs to be engineered to keep the indicator member and the wheel of this mobile secured to one another in the event of an accidental knock.

The kinematics of the hammer are particularly simple. Triggering of the function causes the hammer to pivot through 360° ($\phi+\alpha+\beta+\delta+\gamma=360°$), always in the same and single direction of rotation. The number of components needed for driving the hammer is therefore reduced to the bare essentials.

The kinematics and geometry of the hammer are designed firstly to bring about the resetting to the predetermined position, and secondly to lock the angular position of the indicator member once it has regained its predetermined position. This device therefore makes it possible, at minimum expense, to eliminate the dynamic effects caused by the sudden restitution of energy, and do so without any additional brake mechanism.

The user has no grasp on the rotation of the hammer. The risks of lingering and partial zero-resets are therefore eliminated.

The hammer acts on the heart-piece in a fraction of a second, namely instantaneously. There is therefore no risk of any impairment to the chronometric performance as a result of a prolonged friction torque.

The device allows the second hand to be reset to zero instantaneously and restarted instantaneously in one single operation, and does so independently of other manipulations to the watch. Thus, the quality of the chronometry is not dependent on the dexterity of the user.

This system is independent of any chronograph mechanism. It requires no rocking lever clutch and alleviates the disadvantages inherent with known friction mechanisms of the prior art.

Figure 20:
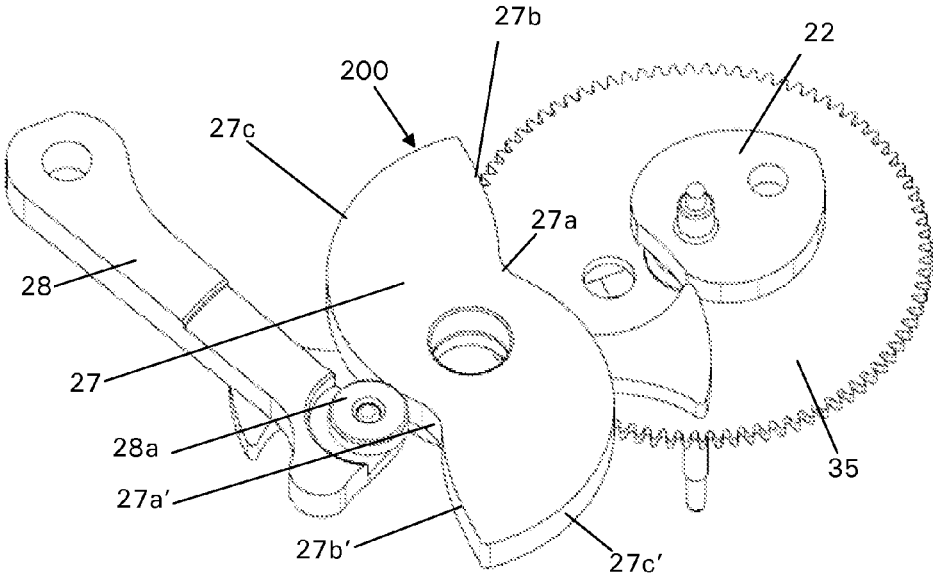
FIGS. 20 and 21 are views of a second embodiment of a device for resetting to a predetermined position according to the invention.
Figure 21:
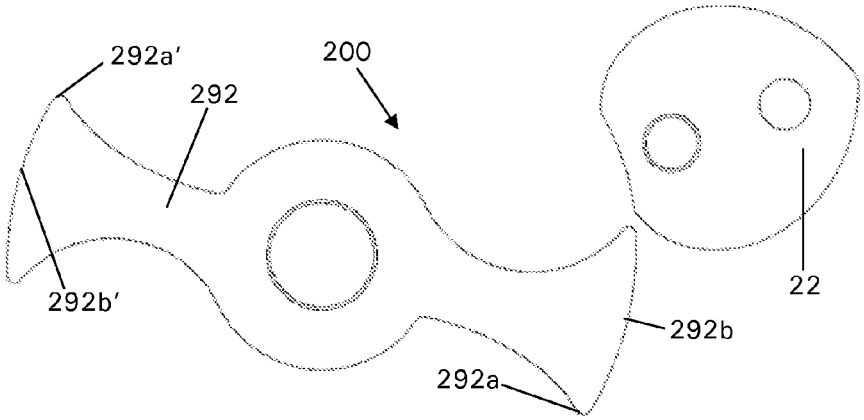

A second embodiment of a device 200 for resetting to a predetermined position an indicator member indicative of a parameter connected with time is described hereinbelow with reference to FIGS. 19 and 20. In this second embodiment, elements that are identical to, similar to, or perform the same function as the elements of the first embodiment are identified by reference signs to which 20 has been added by comparison with the reference signs used for the first embodiment. Thus, for example, the lever referenced 8 in the figures depicting the first embodiment is referenced 28 in the figures depicting the second embodiment. Likewise, for example, the cam is referenced 2 in the figures depicting the first embodiment and is referenced 22 in the figures depicting the second embodiment. In this embodiment, the angular range of rotation of the hammer has been reduced for size reasons. The cam 27 and the hammer 292 are designed to rotate through 180° in a single direction of rotation when the function is triggered. The functional surfaces of the cam 27 and of the hammer 292 are therefore duplicated. The duplicated surfaces have been reference using a "'". The way in which the second embodiment works is entirely similar to the working of the first embodiment, particularly the fact that the cam and the hammer travel in a single direction of rotation, with no reversal of the direction of movement during the function of resetting to the predetermined position. It is also possible to conceive of a hammer that rotates through an angle of 120° or 90°, or more generally 360°/m, where in particular m=1 or 2 or 3 or 4. This solution would make it possible, for example, to drive several heart-pieces, in this particular instance n heart-pieces, the centers of which are distributed on a circle concentric with the axis of the hammer, so as to reset n indicator members to n predetermined positions, where in particular n=1 or 2 or 3 or 4. If n=m, each of the panes of the hammer may act on one heart-piece each time the hammer is actuated.

Thus, in the two embodiments described hereinabove, the device comprises the element that actuates or transmits movement to the return element thanks to energy from the accumulator. The energy is applied to the energy accumulator by the user via the control member 4 that brings about the reset to the predetermined position and via the element that transmits energy to the energy accumulator and that triggers operation of the return element. The control member is able to be manipulated or moved or maneuvered or handle by the user.

In the embodiments described above, the indicator member is mechanically connected by friction to the drive mobile. Nevertheless, it would be possible to use a clutch system in place of the friction system. In such a case, declutching would be controlled during the phase of action of the return element, namely during the step of resetting to zero by action of the hammer on the heart-piece, then during the securing step.

It is of course conceivable for this device to be inserted inside a chronograph mechanism. Each indication of the counting chain of the chronograph, for example the indication of seconds, minutes and hours, then has its own corresponding heart-piece that can be actuated by the hammer. Depending on the design adopted, these heart-pieces could be arranged concentrically or alternatively could be distributed in such a way that their centers are spread out in a circle concentric with the axis of the hammer so that they can be actuated in sequence by the zero-reset hammer for a duration of the order of one tenth of a second, notably by one and the same pane of the zero-reset hammer for a duration lasting of the order of one tenth of a second.

The invention claimed is:

1. A device for resetting to a predetermined position an indicator member indicative of a parameter connected with time, the indicator member being kinematically linked to a drive wheel, the device comprising:

a control member, the control member being able to be manipulated by a user, an energy accumulator, the energy accumulator accumulating energy from a movement of the control member, the energy being supplied to the energy accumulator by the user via the control member, and a resetting element for resetting the indicator member indicative of the parameter connected with time to the predetermined position, wherein a resetting movement of the resetting element is in a direction of resetting the indicator member to the predetermined position, and wherein the resetting movement is powered by the energy from the energy accumulator.

2. The device as claimed in claim 1, wherein the indicator member is kinematically linked to the drive wheel by friction or by a clutch.

3. The device as claimed in claim 1, wherein the resetting element comprises a hammer:

collaborating with a cam kinematically linked in terms of rotation to the indicator member, and mounted to rotate about an axis.

4. The device as claimed in claim 3, wherein the hammer performs a one-way rotational movement as the hammer is actuated.

5. The device as claimed in claim 4, wherein the hammer performs a rotational movement of 1/m of a revolution as the hammer is actuated, wherein m is any one of 1, 2, 3, and 4.

6. The device as claimed in claim 3, wherein the hammer comprises a pane intended to strike the cam and a securing element intended to stop the indicator member in the predetermined position.

7. The device as claimed in claim 6, wherein the securing element collaborates with a complementary profile on the cam, wherein a profile of the securing element forms an arc of more than 180°.

8. The device as claimed in claim 1, wherein the device comprises a transmission element for transmitting movement from the energy accumulator to the resetting element.

9. The device as claimed in claim 8, wherein the transmission element comprises a first cam kinematically linked to the resetting element.

10. The device as claimed in claim 9, wherein the transmission element comprises a runner returned into contact with the first cam by the energy accumulator, the energy accumulator comprising an elastic element.

11. The device as claimed in claim 1, wherein the device comprises an energy transmission element for transmitting energy to the energy accumulator and for triggering operation of the resetting element.

12. The device as claimed in claim 11, wherein the energy transmission element that transmits energy and triggers operation of the resetting element comprises a rocking lever and a second cam, the rocking lever being able to act on the second cam to cause the second cam to rotate, the second cam being kinematically linked in terms of rotation to the resetting element.

13. The device as claimed in claim 12, wherein the rocking lever comprises a finger mounted to pivot about an axis and returned to a rest position by an elastic element, the rocking lever acting on the second cam via the finger.

14. The device as claimed in claim 11, wherein the control member is able to act on the energy transmission element that transmits energy to the energy accumulator and that triggers operation of the resetting element.

15. The device as claimed in claim 1, wherein the energy is provided to the energy accumulator beforehand by the user via the control member for controlling the resetting of the indicator member to the predetermined position.

16. A timepiece movement comprising a device as claimed in claim 1.

17. The movement as claimed in claim 16, wherein the device is a "flyback" device, and wherein a resumed drive to the indicator member from the drive wheel following an action of the resetting element is independent of the position of the control member.

18. A timepiece comprising a device as claimed in claim 1.

19. A timepiece movement as claimed in claim 16, additionally comprising a second indicator member indicating the same parameter as the first indicator member and permanently connected to a drive mobile.

20. A device for resetting to a predetermined position an indicator member indicative of a parameter connected with time, the device comprising:

a resetting element for resetting the indicator member indicative of the parameter connected with time to the predetermined position, the resetting element comprising a hammer:

collaborating with a cam kinematically connected in terms of rotation to the indicator member, and mounted to rotate about an axis, wherein the hammer performs successive resetting movements that reset the indicator member to the predetermined position, wherein the hammer performs a repositioning movement between successive resetting movements, and wherein the repositioning movement is in a same rotational direction as the resetting movement.

21. The device as claimed in claim 20, wherein the device comprises an energy accumulator, the resetting element being powered by energy from the energy accumulator.

22. A timepiece movement comprising a device as claimed in claim 20.

23. The movement as claimed in claim 22, wherein the device is a "flyback" device, and wherein the resumed drive to the indicator member from the drive wheel following the action of the resetting element is independent of the position of the control member.

24. A timepiece movement as claimed in claim 22, additionally comprising a second indicator member indicating the same parameter as the first indicator member and permanently connected to a drive mobile.

25. A timepiece comprising a device as claimed in claim 20.

* * * * *